US008746433B2

(12) United States Patent
Seki

(10) Patent No.: US 8,746,433 B2
(45) Date of Patent: Jun. 10, 2014

(54) DOCUMENT HANDLER HAVING VALIDATOR DETACHABLY ATTACHED THERETO

(75) Inventor: Toru Seki, Tokyo (JP)

(73) Assignee: Japan Cash Machine Co., Ltd., Osaka (JP)

( * ) Notice: Subject to any disclaimer, the term of this patent is extended or adjusted under 35 U.S.C. 154(b) by 0 days.

(21) Appl. No.: 12/842,156

(22) Filed: Jul. 23, 2010

(65) Prior Publication Data

US 2011/0094850 A1 Apr. 28, 2011

(30) Foreign Application Priority Data

Oct. 26, 2009 (JP) ..... 2009-245957

(51) Int. Cl.
*G07F 7/04* (2006.01)

(52) U.S. Cl.
USPC ..... 194/206

(58) Field of Classification Search
USPC ..... 209/534; 194/206, 207
See application file for complete search history.

(56) References Cited

U.S. PATENT DOCUMENTS

| | | | | |
|---|---|---|---|---|
| 5,372,361 | A | 12/1994 | Isobe et al. | |
| 5,616,915 | A * | 4/1997 | Simpkins et al. | 250/221 |
| 5,907,141 | A | 5/1999 | Deaville et al. | |
| 5,996,888 | A * | 12/1999 | Gromatzky | 232/15 |
| 7,004,381 | B2 | 2/2006 | Fukuda et al. | |
| 7,104,383 | B1 | 9/2006 | Saltsov et al. | |
| 2002/0060421 | A1 | 5/2002 | Kako et al. | |
| 2002/0121422 | A1 | 9/2002 | Shibata et al. | |
| 2004/0262380 | A1 | 12/2004 | Fukuda et al. | |
| 2009/0302529 | A1 | 12/2009 | Seki et al. | |

FOREIGN PATENT DOCUMENTS

| | | | |
|---|---|---|---|
| CN | 1401110 | A | 3/2003 |
| CN | 1577412 | A | 2/2005 |
| EP | 0662676 | | 7/1995 |
| EP | 1443474 | | 8/2004 |
| EP | 2053566 | | 4/2009 |
| JP | 2009-295125 | | 12/2009 |
| TW | 367471 | A1 | 8/1999 |
| TW | 526162 | | 4/2003 |
| TW | 530270 | | 5/2003 |
| TW | 200745995 | A | 12/2007 |
| WO | 9803945 | A1 | 1/1998 |
| WO | 2009150774 | A1 | 12/2009 |

OTHER PUBLICATIONS

International Search Report for PCT/JP2010/006325.
Taiwanese Office action for Taiwan Application No. 099136967 dated Nov. 12, 2013.

(Continued)

*Primary Examiner* — Jeffrey Shapiro
(74) *Attorney, Agent, or Firm* — Bachman & LaPointe, P.C.

(57) ABSTRACT

A document handler is provided which comprises a connector 4 made up of cam guides 5 and followers 6 detachably connected to cam guides 5 to detachably attach a validator 2 to a frame 1 in document handler. Cam guides 5 are formed on a pair of side walls 41 of frame 1, and followers 6 are formed on a pair of side walls 51 of validator 2. Each cam guide 5 comprises a distal path 10 for guiding movement of follower 6 to transport validator 2 in a spaced relation to bracket 7, and an access path 11 for guiding follower 6 passed through distal path 10 to bring validator 2 to the fixed position.

16 Claims, 17 Drawing Sheets

(56) References Cited

OTHER PUBLICATIONS

Supplementary European Search Report for EP Application No. 10826325.2 dated May 15, 2013.

Chinese Office action for CN Application No. 201080056289.9 dated Apr. 2, 2014.

* cited by examiner

DOCUMENT HANDLER HAVING VALIDATOR DETACHABLY ATTACHED THERETO

TECHNICAL FIELD

This invention relates to a document handler having a validator detachably attached thereto for validating documents inserted into validator, and a stacker for storing documents sent from validator.

BACKGROUND OF THE INVENTION

FIG. 23 exemplifies a prior art bill handling apparatus mountable in vending machines, bill exchangers, automatic teller machines, automatic cash dispensers and gaming machines, and an example of such a bill handling apparatus is shown in for example U.S. Pat. No. 5,372,361. A shown bill handling apparatus 100 comprises a frame 111, a validator 101 secured to frame 111 for discriminating authenticity of bills inserted into validator 101, a stacker 3 detachably attached to frame 111. Validator 101 comprises a conveyer device 102 for transporting a validated bill along a passageway 107 to stacker 3. Stacker 3 comprises a case 106, a slit-like opening 110 formed in case 106 through which bills pass from an outlet 109 of passageway 107 of validator 101 into stacker 3, a chamber 108 formed in stacker 3 for temporarily retaining a bill therein, a storage 104 defined in case 106 for stowing bills therein, and a pusher device 105 removably disposed within chamber 108 for pushing the bill in chamber 108 into storage 104.

When stacker 3 is attached to frame 111, opening 110 of stacker 3 is brought into alignment with an outlet 109 of passageway 107 in conveyer device 102 to connect outlet 109 to opening 110, and simultaneously, a follower gear 113 is automatically brought into engagement with a drive gear 112 provided in conveyer device 102 which directly drives follower gear 113.

When a control circuit (not shown in the drawings) in validator 101 decides an inserted bill to be genuine, it drives conveyer device 102 so that the bill is transported along passageway 107 toward outlet 109. At the same time, as conveyer device 102 drives follower gear 113 through drive gear 112 in the forward direction, follower gear 113 operates a carrier device (not shown in the drawings) in stacker 3 and therefore, the bill is moved by conveyer device 102 and carrier device through outlet 109 and opening 110 into chamber 108 within case 106.

At this moment, conveyer device 102 is driven in the adverse direction to reverse drive gear 112 and follower gear 113 to thereby operate pusher device 105 which forcibly pushes and stows the bill in chamber 108 into storage 104. During forward rotation of drive and follower gears 112, 113, pusher device 105 is returned to its shown original position.

In the foregoing bill handling apparatus, when stacker 3 is attached to frame 111, follower gear 113 of pusher device 105 can automatically be brought into engagement with drive gear 112 of carrier device secured to frame 111. Not shown in FIG. 23, but a shock absorber is provided in drive or follower gear 112, 113 to buffer a mechanical shock occurring upon interlocking drive and follower gears 112 and 113.

FIG. 24 shows a prior art structure for removably interlocking validator 101 to frame 111 by sliding validator 101 on frame 111 for fixing. As illustrated, frame 111 is formed with a pair of hooks 115 in a connecting structure 116 on its upper surface, and an opening 117 is formed on a bottom surface of validator 101. After sliding movement of validator 101 on upper surface of frame 111, edges of opening 117 are brought into engagement with hooks 115 to removably attach validator 101 to frame 111 by sliding movement of validator 101 relative to frame 111. However, this connecting structure 116 disadvantageously has a defect because when validator 101 is mounted on frame 111 through the sliding movement, drive gear 112 of carrier 102 in validator 101 naturally clashes with hooks 115 and therefore suffers a mechanical damage by the clash. Accordingly, hooks 115 have to be made of flexible material elastically deformable when drive gear 112 clashes with hooks 115. Also, as connecting structure 116 includes hooks 115 for catching edge of opening 117 in validator 101, it disadvantageously requires an increased height or additional space for bill handling apparatus to arrange connecting structure 116 therein. In this case, if bill handling apparatus is made in a larger size, it would be subject to restriction in size by standards, and therefore, volume in stacker 3 has to be made smaller in terms of the size in validator 101 and frame 111, and also, smaller stacker 3 cannot accommodate longer kinds of bills than chamber 108.

Accordingly, an object of the present invention is to provide a document handler designed to detachably attach a validator thereto. Another object of the present invention is to provide a document handler designed to have a connector for removably attaching a validator to a frame in the fixed position without undesirable physical contact of a conveyer device in the validator to any other parts. A still another object of the present invention is to provide a document handler designed to detachably attach a validator to a frame in the fixed position for driving connection of a conveyer device to a carrier device and a pusher device in a stacker. A further object of the present invention is to provide a document handler to have a connector made up of a cam guide and a follower in removable engagement with the cam guide formed as configurations on side walls of a frame and a validator provided in the document handler. A still further object of the present invention is to provide a document handler designed to detachably attach a validator to a frame without need of any additional device between the validator and frame.

SUMMARY OF THE INVENTION

The document handler according to the present invention, comprises: a frame (1) having a pair of side walls (41) and a bracket (7) for connecting side walls (41) of frame (1), a validator (2) detachably attached to frame (1) and having a conveyer device (102), and a connector (4) for detachably attaching validator (2) to frame (1). Connector (4) comprises a cam guide (5) formed on at least one of side walls (41) in frame (1) or on at least one of side walls (51) in validator (2), and a follower (6) formed on at least one of side walls (51) in validator (2) or on at least one of side walls (41) in frame (1) to detachably bring follower (6) into engagement with cam guide (5). In this arrangement, validator (2) may be removably attached to the fixed position in frame (1) for easy exchange. Cam guide (5) comprises a distal path (10) for guiding movement of follower (6) to transport validator (2) in a spaced relation to bracket (7), and a access path (11) for guiding follower (6) to bring validator (2) to a fixed position after follower (6) has passed distal path (10). In mounting validator (2) to frame (1) or dismounting validator (2) from frame (1), distal path (10) of cam guide (5) serves to guide movement of follower (6) along distal path (10) without physical contact of conveyer device (102) in validator (2) to bracket (7) while averting mechanical damage to conveyer device (102). Also, as in the present invention, a slip-on construction between cam guide (5) and follower (6) in connector (4) is very advantageous because of prompt connection and separation of validator (2) relative to frame (1) without any additional part or arrangement.

Thus, the connector beneficially does not require any additional or further device to drivingly connect the validator and stacker without incurring increase in height of the document handler and without need of any additional arrangement because both cam guide and follower in the connector can be formed as configurations of both side walls in the frame and validator.

BRIEF DESCRIPTION OF THE DRAWINGS

The above-mentioned and other objects and advantages of the present invention will be apparent from the following description in connection with preferred embodiments shown in the accompanying drawings wherein.

BEST MODE FOR CARRYING OUT THE INVENTION

Described hereinafter in connection with FIGS. 1 to 22 of the drawings will be embodiments of a bill handling apparatus as a document handler according to the present invention. In the description herein, a word "front" or "foreside" denotes the forward part or left hand in FIG. 13 of a bill validator 2 involving a bill inlet 53 on an X-axis, a wording "back" or "rear side" denotes the hind part or right hand in FIG. 13 of bill validator 2 on X-axis. A word "top" or "upside" denotes the upward part of bill validator 2 on a Y-axis, and a word "bottom" or "downside" denotes the downward part of bill validator 2 on Y-axis. All words "detachable", "removable" and "separable" indicate the same meaning of "demountable".

Figure 1:
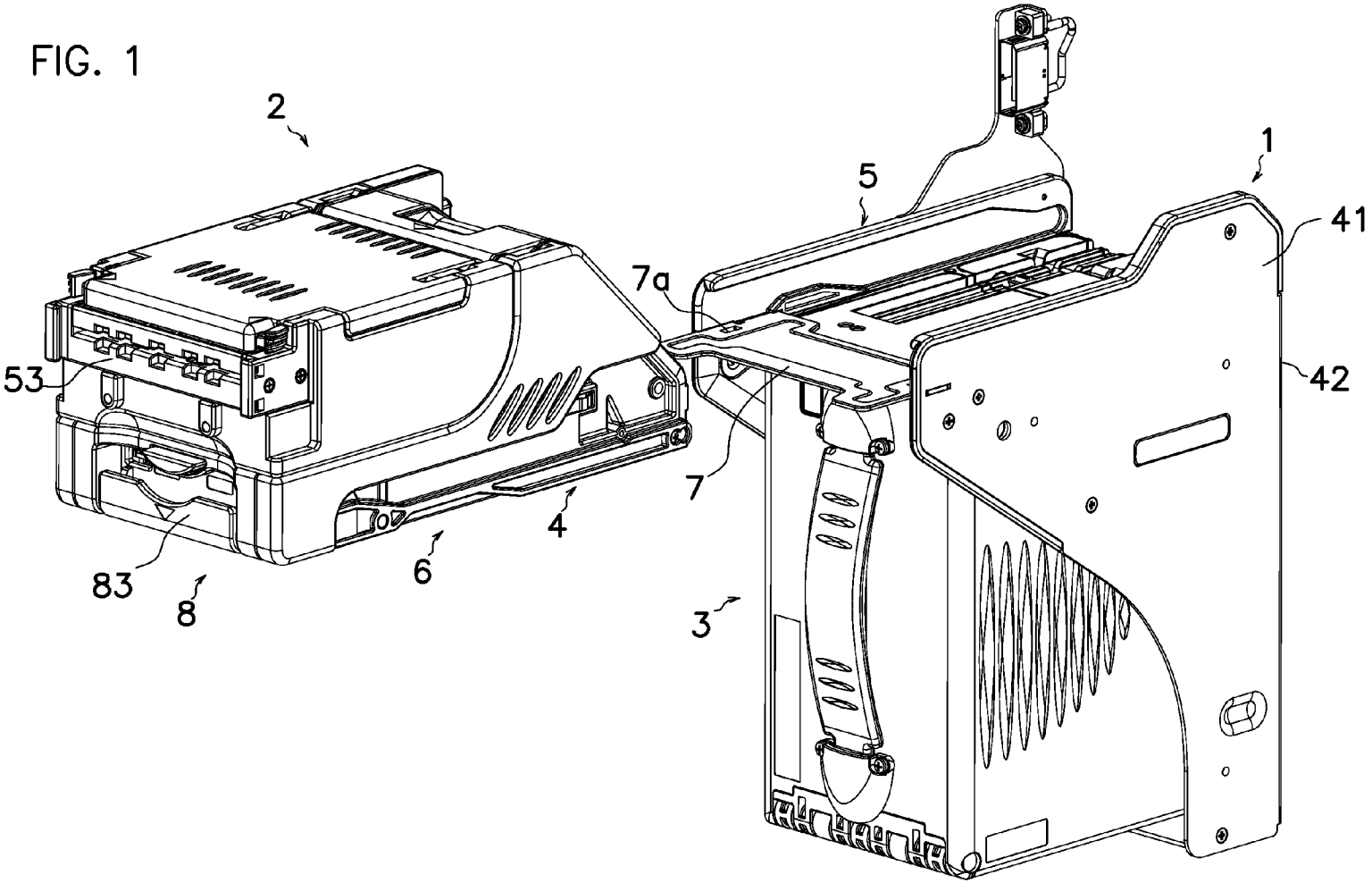
FIG. 1 is a perspective view of a bill handling apparatus as a document handler according to the present invention with a validator removed from a frame.

As seen from FIG. 1, the bill handling apparatus according to the present invention, comprises: a frame 1, a validator 2 detachably attached to frame 1, a connector 4 provided between frame 1 and validator 2 for detachably attaching validator 2 to frame 1, and a stacker 3 detachably attached to frame 1 for stowing therein bills transported from validator 2. In the shown embodiment in FIG. 1, frame 1 has a pair of side walls 41, a rear wall 42 for connecting each rear part of side walls 41, and a bracket 7 bridged and connecting front portions of side walls 41. Connector 4 comprises cam guides 5 formed on a pair of vertically disposed side walls 41 in frame 1, and followers 6 formed on a pair of vertically disposed side walls 51 in validator 2 so that followers 6 may be inserted into mating cam guides 5 for attachment of validator 2 to frame 1. Bracket 7 is horizontally disposed at a right angle and connected to side walls 41 in frame 1. A latch device 8 is disposed at the front end of validator 2 between validator 2 and bracket 7 to securely fasten validator 2 to bracket 7 to prevent contingent movement of validator 2 in the withdrawal direction. Frame 1, each outer cell of validator 2 and stacker 3 may be formed by injection molding of a resin material selected from the group consisting of ABS resin, polycarbonate resin, acrylic resin, polyamide resin, polyacetal resin and any mixed compound of these resins or by press forming of metallic plates such as aluminum, iron or any alloy of these metals. Accordingly, connector 4 may be formed of molding resin, forming metal or combined material of resin and metal.

Figure 2:
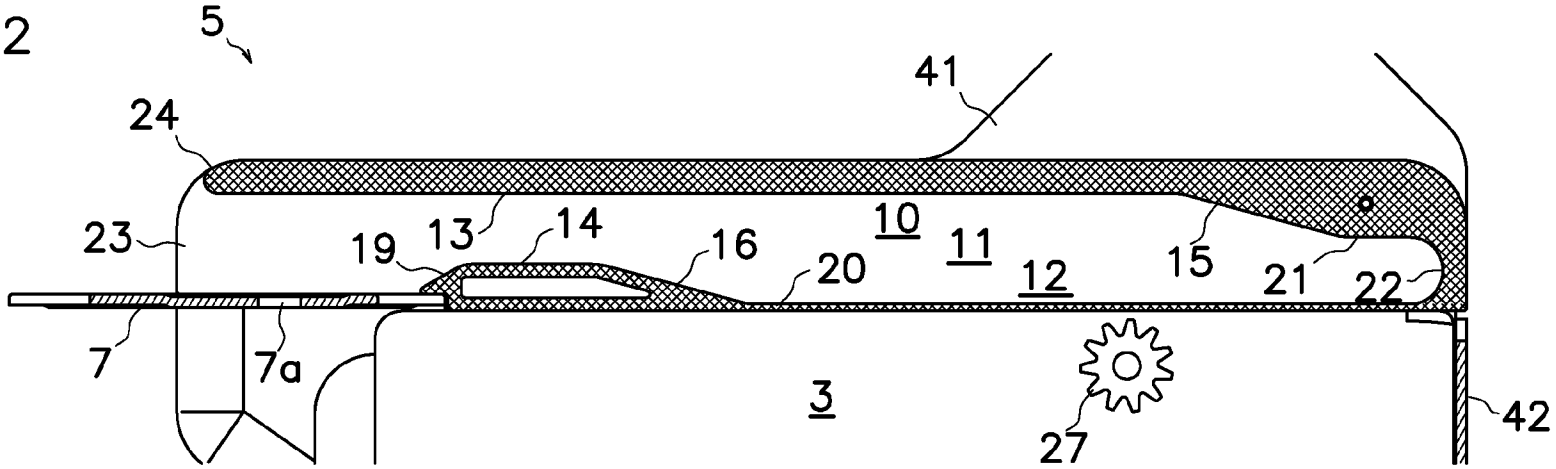
FIG. 2 is a partial side elevation view of a cam guide formed on the frame shown in FIG. 1.
Figure 3:
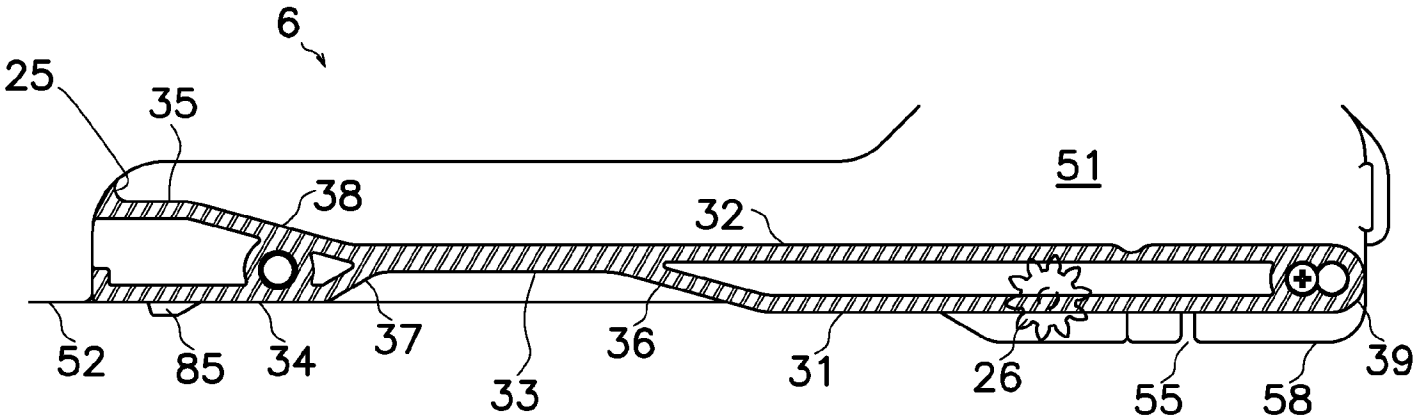
FIG. 3 is a partial side elevation view of a follower formed on the validator shown in FIG. 1.

In an embodiment shown in FIG. 2, each cam guide 5 comprises a horizontal distal path 10 formed on side wall 41 in frame 1, an aslope access path 11 connected to a bottom of distal path 10, and a horizontal proximal path 12 connected to a bottom of access path 11. Distal path 10 comprises a distal surface 13 formed opposite to bracket 7, a ridged surface 14 protruded toward distal surface 13 and an inlet incline 19 formed in front of ridged surface 14. Access path 11 is formed between distal and proximal paths 10 and 12 to comprise a back ramp 15 connected to distal surface 13 and an anterior ramp 16 connected to ridged surface 14 and disposed in parallel to back ramp 15. Proximal path 12 comprises a proximal surface 20 continuously extending from anterior ramp 16 and disposed in parallel to distal surface 13, a latch surface 21 continuously extending from back ramp 15 and disposed in parallel to distal surface 13, and an innermost surface 22 formed between proximal and latch surfaces 20 and 21.

Bracket 7 is attached and secured to frame 1 in front of inlet incline 19 to define an inlet 23 of distal path 10 in cooperation with distal surface 13.

Follower 6 comprises a proximal flat 31, a distal flat 32 formed in parallel to and in upwardly spaced relation to proximal flat 31, an intermediate ramp 36 connected to proximal flat 31 and disposed in parallel to anterior ramp 16, an intermediate flat 33 connected to intermediate ramp 36 and disposed in parallel to and in upwardly spaced relation to proximal flat 31, a complementary ramp 37 connected to intermediate flat 33, a base flat 34 connected to complementary ramp 37 and disposed in parallel to and in downwardly spaced relation to intermediate flat 33, a stabilizing ramp 38 connected to distal flat 32 and disposed in parallel to intermediate ramp 36, and an anterior flat 35 connected to stabilizing ramp 38 and disposed in parallel to and in upwardly spaced relation to distal flat 32, a rising 25 formed at an end of anterior flat 35 to come into contact to or confrontation with an edge 24 of inlet 23 in distal path 10 when follower 6 is inserted into cam guide 5, and an arcuate end surface 39 connecting proximal and distal flats 31 and 32. Arcuate end surface 39 has a complementary arcuate shape to that of innermost surface 22 of proximal path 12.

Figure 4:
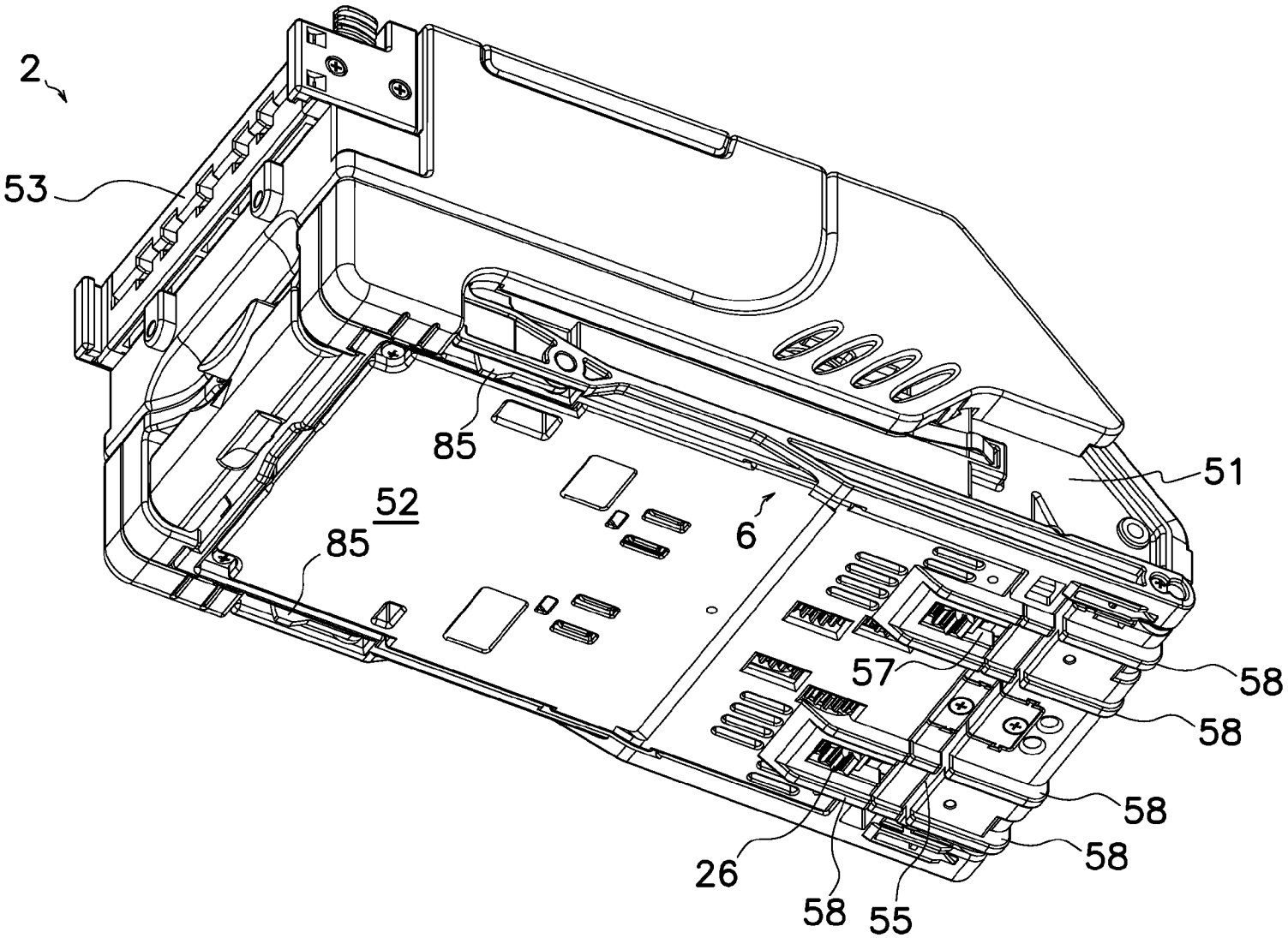
FIG. 4 is a perspective bottom view of the validator.
Figure 5:
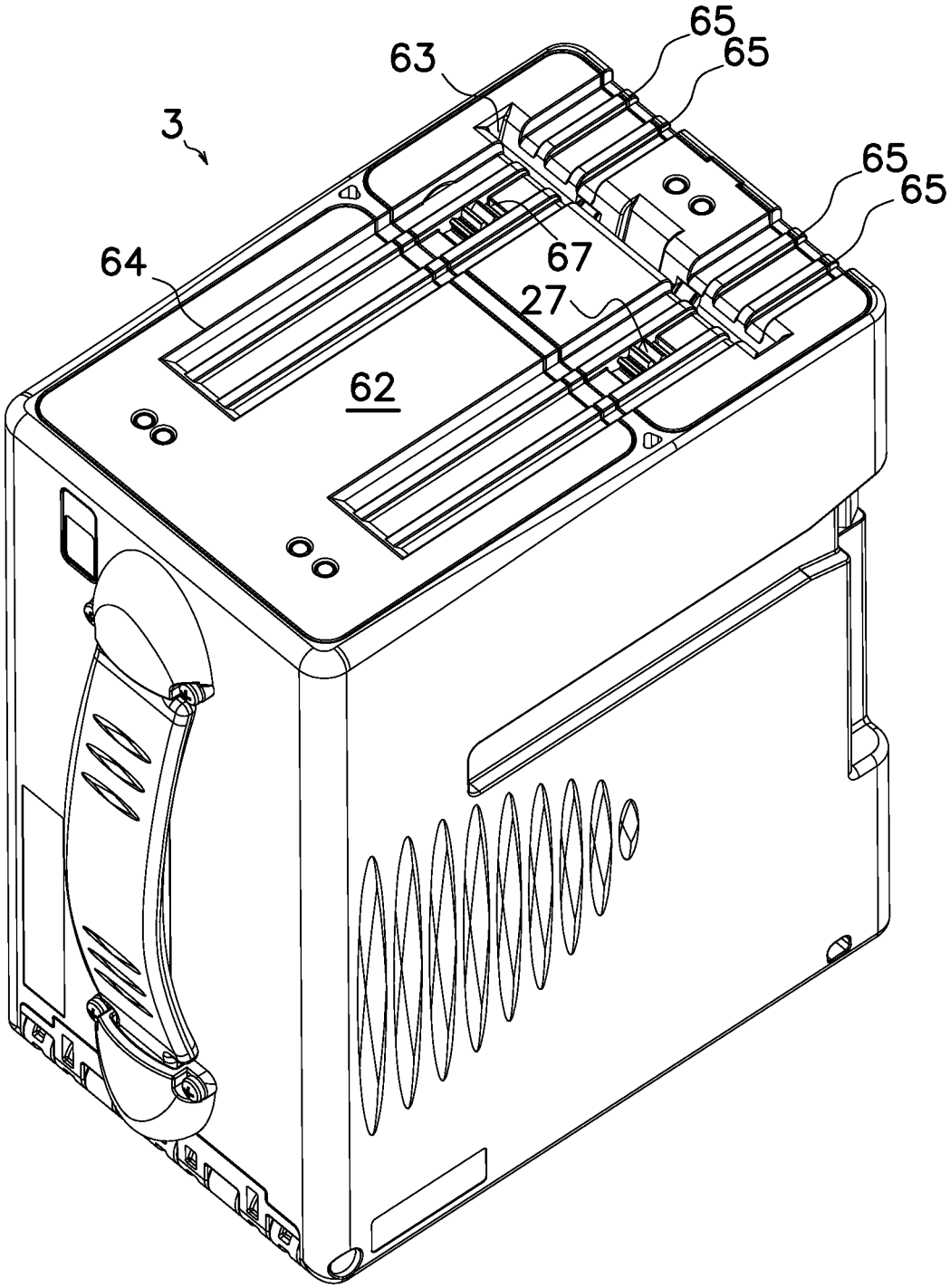
FIG. 5 is a perspective top view of a stacker.
Figure 6:
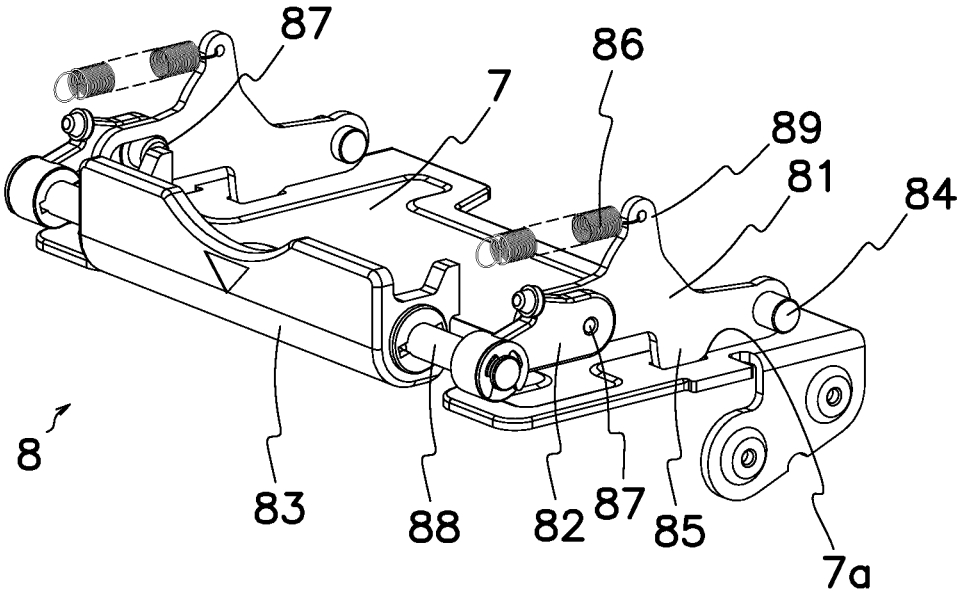
FIG. 6 is a perspective view of a latch device for removably fastening the validator to the frame.
Figure 7:
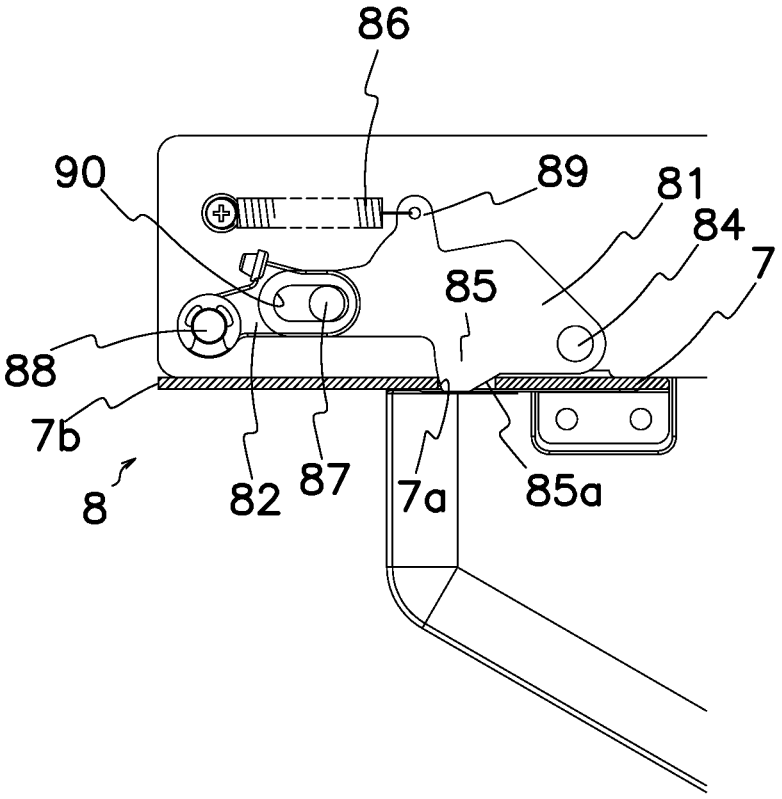
FIG. 7 is a side elevation view of the latch device.
Figure 8:
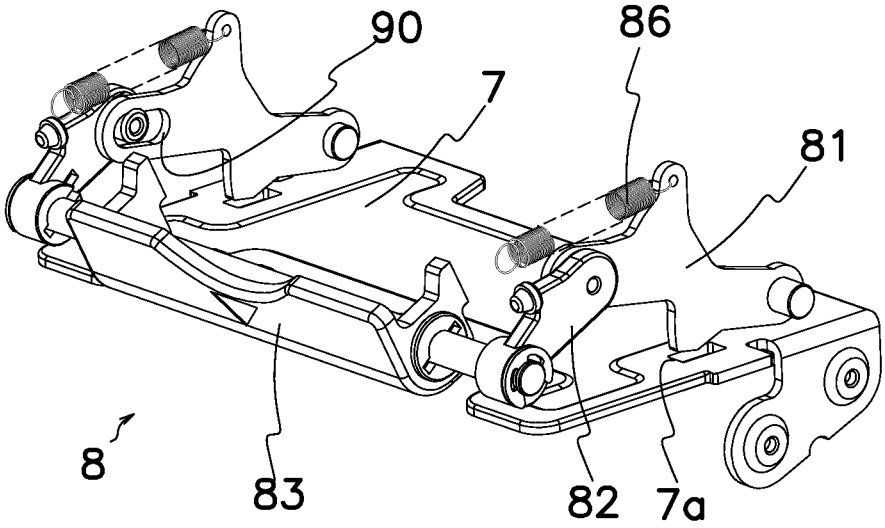
FIG. 8 is a perspective view of the latch device in the released condition of the validator disengaged from the frame.
Figure 9:
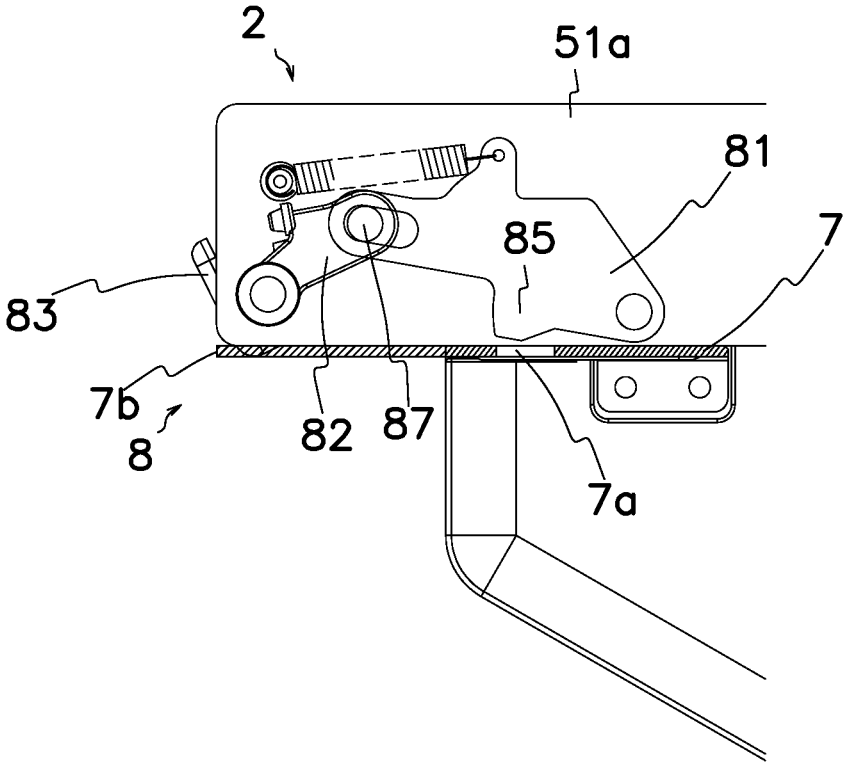
FIG. 9 is a side elevation view of the latch device shown in FIG. 8.
Figure 13:
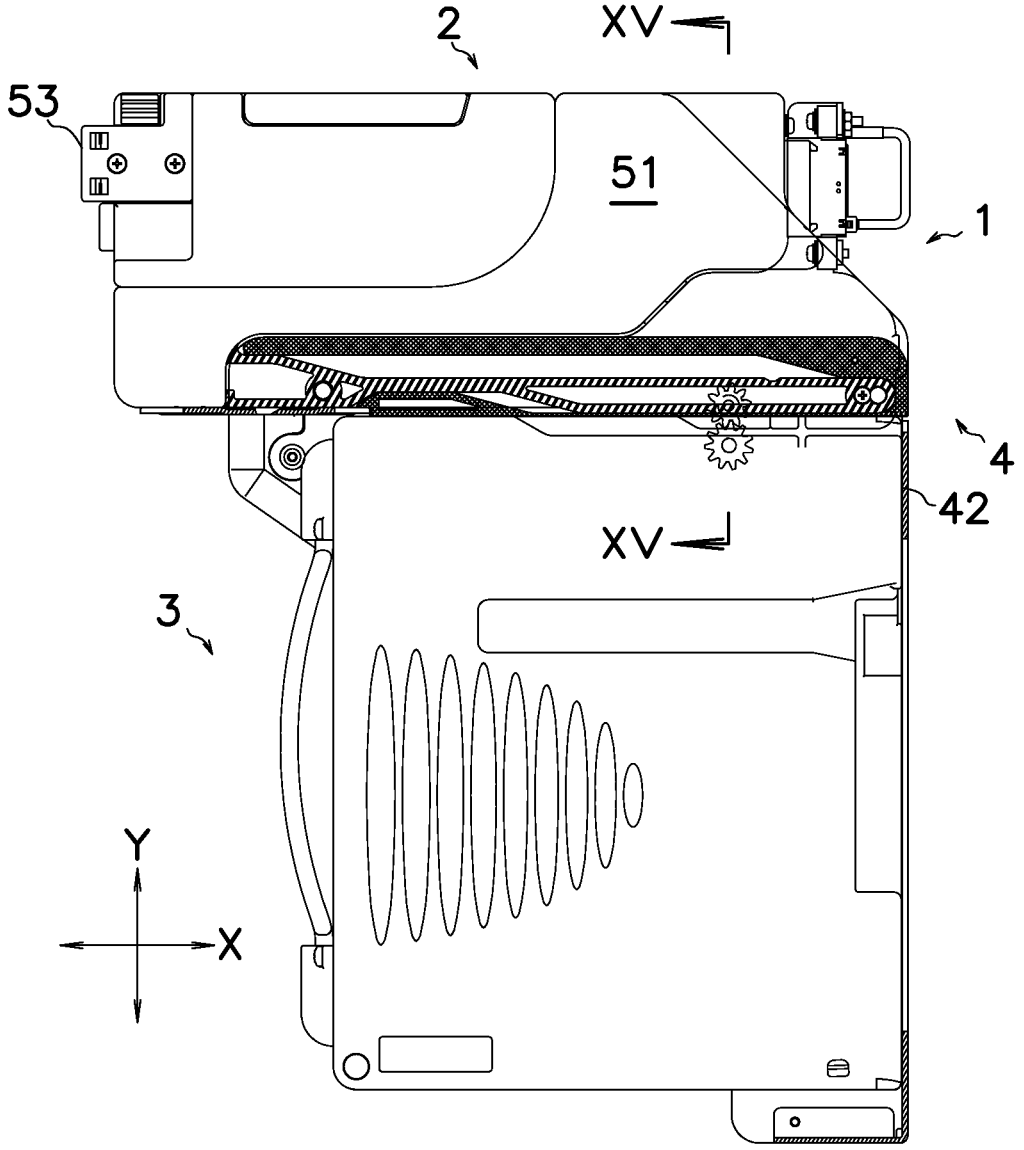
FIG. 13 is a sectional view showing the follower completely inserted into the fixed position of a proximal path in the cam guide.
Figure 14:
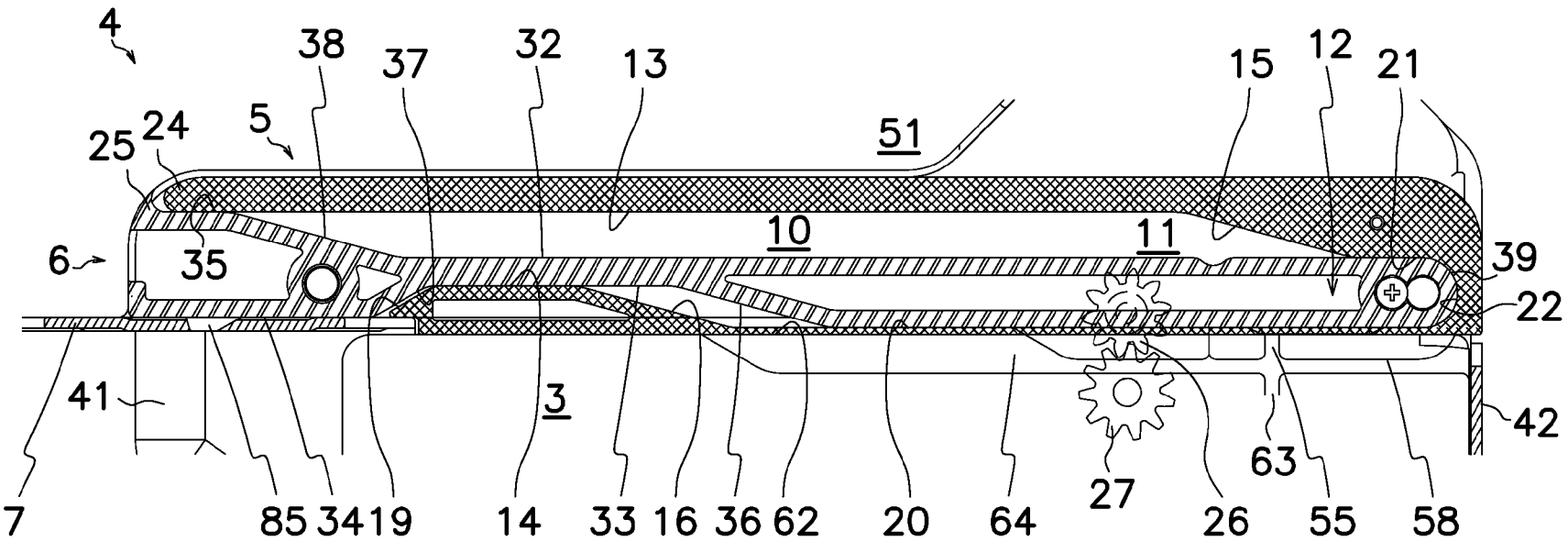
FIG. 14 is a partially sectional enlarged view of the follower in the fixed position.
Figure 23:
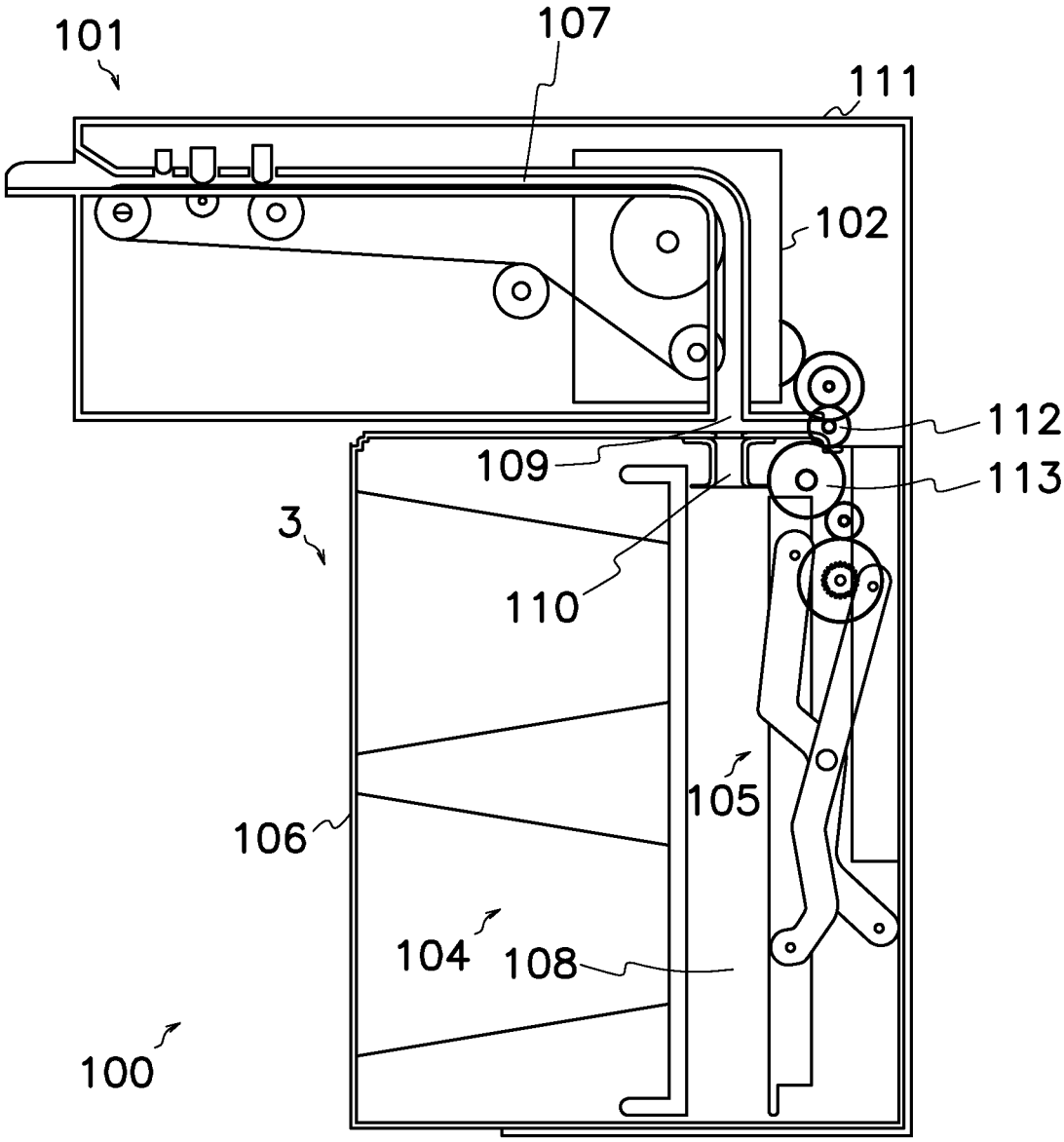
FIG. 23 Prior Art
FIG. 23 is a simplified sectional view of a prior art bill handling apparatus.
Figure 24:
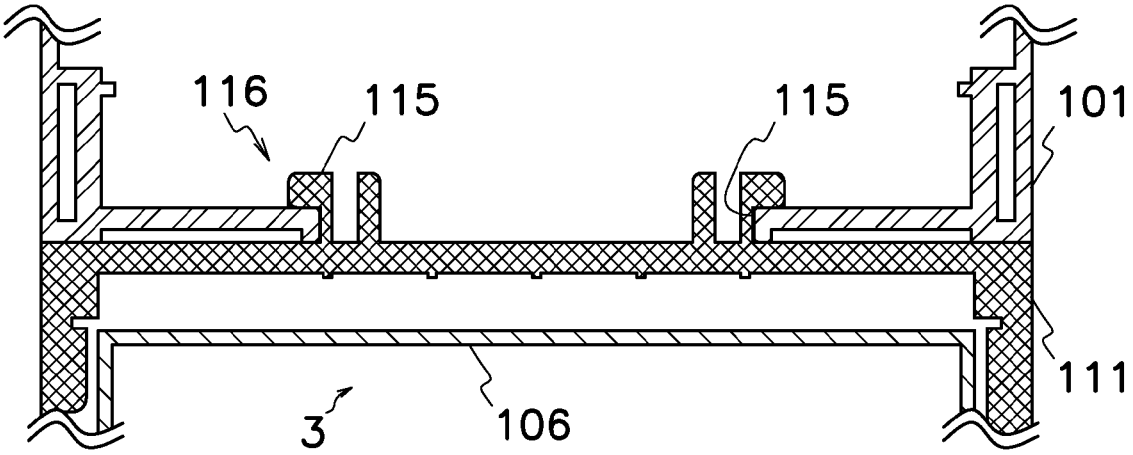
FIG. 24 Prior Art
FIG. 24 is a simplified sectional view of another prior art bill handling apparatus.

FIG. 4 illustrates a pair of drive gears 26 rotatably mounted in validator 2 and driven by conveyer device 102 used to transport a bill through passageway in validator 2 shown in FIG. 23. Drive gears 26 make up a part of conveyer device 102 and a bottom part of drive gears 26 downwardly projects beneath a horizontally disposed bottom surface 52 of validator 2. FIG. 5 demonstrates a pair of follower gears 27 for driving a carrier device (not shown in the drawings) and pusher device 105 in stacker 3. For example, when moved to the innermost of proximal path 12 to bring arcuate end surface 39 of follower 6 into contact to innermost surface 22 of proximal path 12, follower 16 is in the proper fixed position for fixing validator 2 in position to frame 1 with respect to stacker 3 as shown in FIGS. 13 and 14, while drive gears 26 are simultaneously brought into engagement with follower gears 27 to directly drive follower gears 27 through drive gears 26. Here, as seen from FIG. 4, formed on a bottom surface 52 of validator 2 are a laterally elongated outlet 55 of a bill passageway in validator 2, and openings 57 through which drive gears 26 of conveyer device 102 protrude outside of bottom surface 52. Drive gears 26 are in engagement with follower gears 27 to drive carrier device and a pusher device 105 in stacker 3 to transport bill through an inlet 63 to a predetermined standby position in chamber 108 during operation of carrier device and also to stow bill from the standby position to a storage position in stacker 3 during operation of pusher device 105. By way of example, forward and adverse rotations of drive gears 26 respectively and separately drive carrier device and pusher device 105. For example, carrier device may have a one-way rotation clutch for preventing adverse rotation of carrier device during adverse rotation of drive gears 26. To this end, at least a bottom part of drive gears 26 is downward beyond bottom surface 52 in openings 57 to bring them into driving engagement with follower gears 27.

Bottom surface 52 of validator 2 is also formed with a plurality of protective ridges 58 that downward project toward stacker 3 around drive gears 26 from bottom surface 52. Projection length of protective ridges 58 from bottom surface 52 is substantially the same as or more than that of drive gears 26 to completely surround drive gears 26 by protective ridges 58. Protective ridges 58 extend in parallel to each other and perpendicularly to outlet 55 of bill passageway. As shown in FIG. 5, a top surface 62 of stacker 3 comprises inlet 63 for receiving bill transported from validator 2, a plurality of or four inwardly hollow and straight grooves 64 extending lengthwise or perpendicularly to inlet 63 and in parallel to each other, and ridges 65 formed on top surface 62 between each follower gear 27 and each groove 64. When mounting validator 2 to frame 1, bottom surface 52 of validator 2 comes to be disposed in parallel to top surface 62 of stacker 3, and at the same time, drive gears 26 of validator 2 become meshed with follower gear 27 of stacker 3; protective ridges 58 of validator 2 come into interlocked engagement with mating grooves 64 of stacker 3; drive gears 26 and protective ridges 58 of validator 2 are located to sandwich ridges 65 of stacker 3 therebetween; and outlet 55 of validator 2 is rendered properly aligned with inlet 63 of stacker 3.

As shown in FIGS. 6 to 9, latch device 8 of validator 2 comprises a ratchet lever 81 rotatably mounted on bracket 7 around a shaft 84, a rotatable operation lever 82 secured on an axis 88, a handle 83 secured on axis 88 and a tensile spring 86 having one end secured to side wall 51 of validator 2 (FIGS. 7 and 9) and the other end connected to a biased end 89 of ratchet lever 81 to produce a tensile elastic force for resiliently urging ratchet lever 81 in the counterclockwise direction of rotation around shaft 84. Ratchet lever 81 comprises a stopper 85 formed with a lever slant 85*a* which may be caught by an edge of an opening 7*a* formed on bracket 7, and an elongated hole 90 for rotatably receiving a pin 87 secured on operation lever 82. When validator 2 is mounted on frame 1, stopper 85 slides on an upper surface of bracket 7 with lever slant 85*a* in contact to bracket 7, and therefore, lever slant 85*a* forcibly rotates ratchet lever 81 in the clockwise direction against resilient force of tensile spring 86. When handle 83 is manually withdrawn downward, ratchet lever 81 is also forcibly rotated in the clockwise direction to release engagement of stopper 85 from opening 7*a*.

Figure 10:
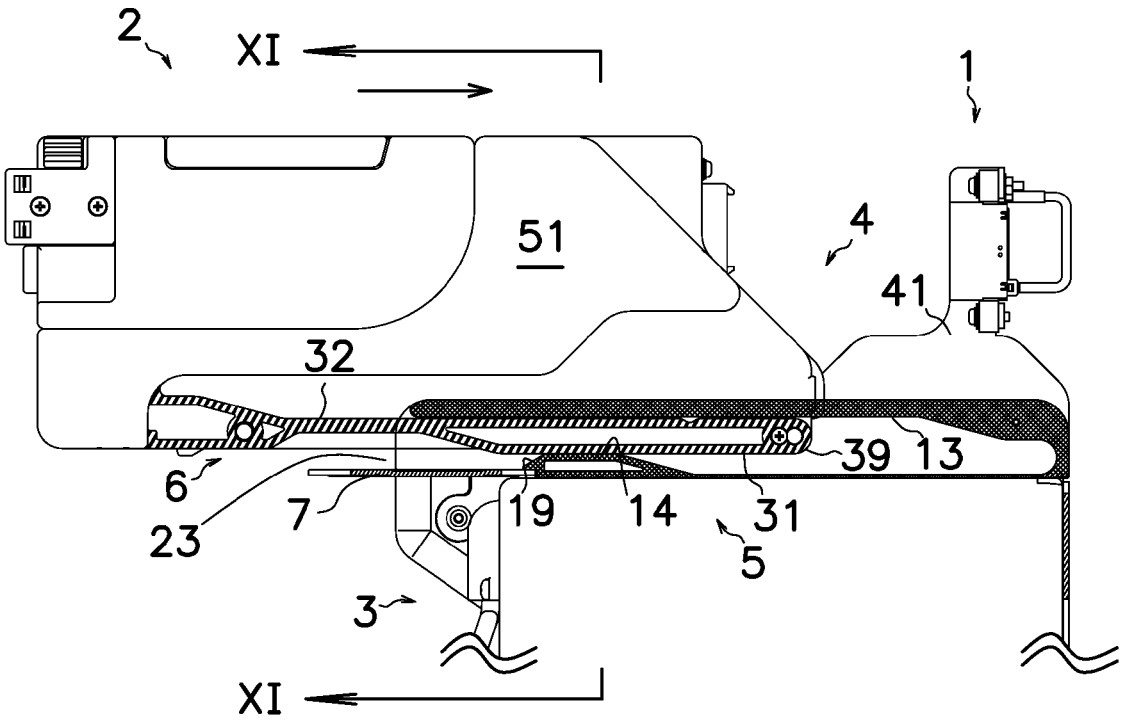
FIG. 10 is a side elevation view showing the follower of the connector inserted into a distal path of the cam guide.
Figure 11:
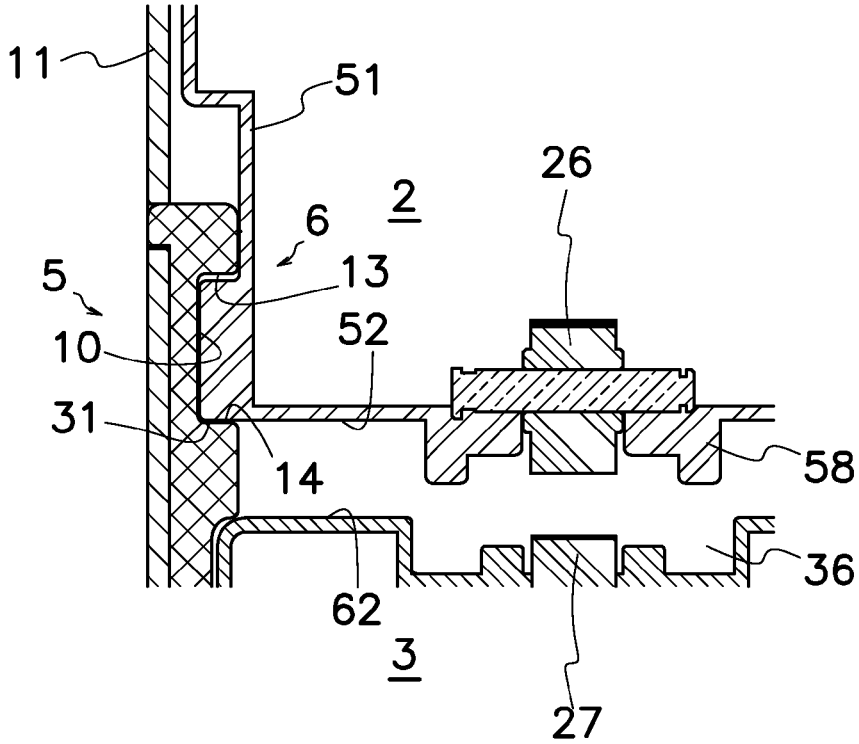
FIG. 11 is a sectional view taken along a line XI-XI of FIG. 10 demonstrating a spaced relationship between drive and follower gears.

As seen from FIGS. 10 and 11, when validator 2 is installed in the fixed position of frame 1, end surface 39 of follower 6 is inserted into inlet 23 of distal path 10 and is brought into contact to inlet incline 19 to guide end surface 39 upward along inlet incline 19 onto ridged surface 14. Then, proximal flat 31 of follower 6 is in contact to and slides on ridged surface 14 to simultaneously bring distal flat 32 of follower 6 to face or be in contact to distal surface 13 of distal path 10, and then proximal flat 31 is inwardly moved along and in sliding contact to distal path 10. In other words, follower 6 is traveled toward the rear of frame 1 in upwardly spaced relation from stacker 3 by a height of ridged surface 14 over bracket 7. Although bottom parts of drive gears 26 and protective ridges 58 are located to project from bottom surface 52 of validator 2, it is possible to prevent unfavorable contact of these bottom parts to bracket 7 and upper surface 62 of stacker 3 while moving follower 6 rearward, because proximal flat 31 of follower 6 is in contact to ridged surface 14 of cam guide 5 to space these bottom parts from bracket 7 and upper surface 62 as shown in FIGS. 10 and 11.

Figure 12:
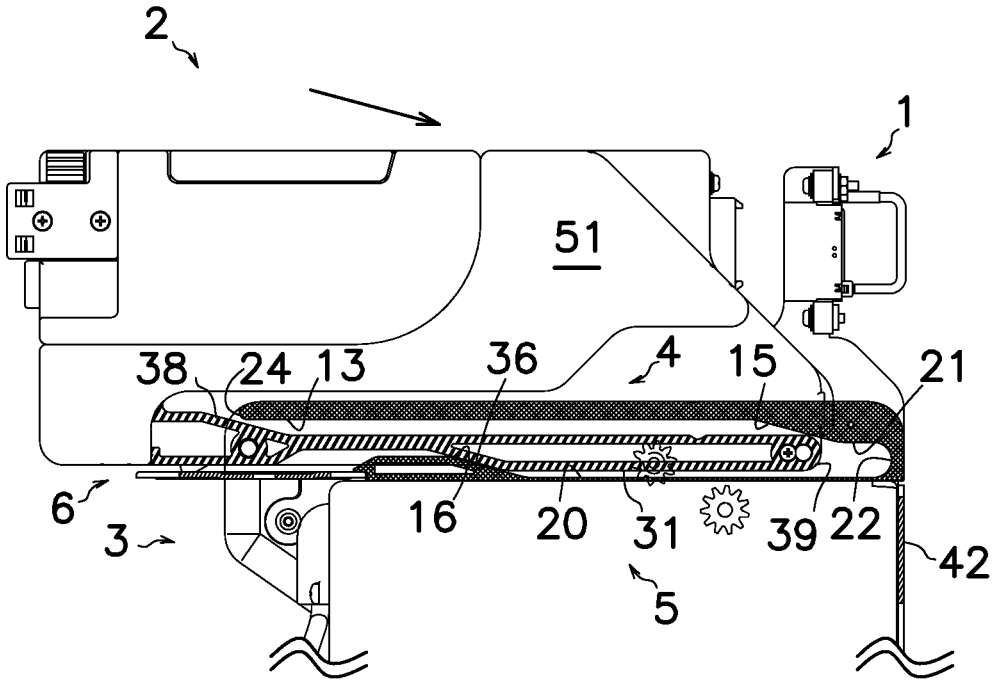
FIG. 12 is a sectional view showing the follower inserted into a access path.

When validator 2 is further inwardly pushed into the rear of distal path 10 from the position shown in FIG. 10, as illustrated in FIG. 12, end surface 39 of follower 6 comes into contact to back ramp 15 to concurrently put intermediate ramp 36 of follower 6 in touch with and slides on anterior ramp 16 so that the whole of follower 6 and validator 2 is moved downwardly toward stacker 3 along access path 11 defined by back and anterior ramps 15 and 16 on the angle shown by an oblique arrow in FIG. 12. Immediately when follower 6 reaches proximal path 12, proximal flat 31 of follower 6 is brought into contact to proximal surface 20, and simultaneously, drive gears 26 and protective ridges 58 are brought into engagement with respectively follower gears 27 and mating grooves 64.

Figure 15:
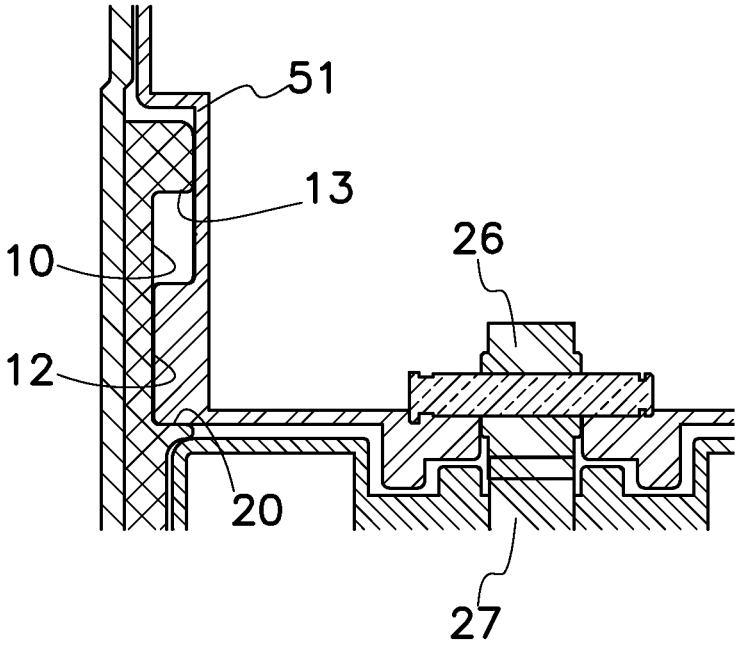
FIG. 15 is a sectional view taken along a line XV-XV in FIG. 13 demonstrating the interlocked drive and follower gears.

Then, validator 2 is further pushed toward the rear of proximal path 12, follower 6 horizontally moves along proximal path 12 of cam guide 5 by a small distance, and finally end surface 39 of follower 6 comes into contact to innermost surface 22 of proximal path 12 to completely put validator 2 in the proper fixed position, at the same time to bring drive gears 26 into secure engagement with follower gears 27 and also to prevent further forward movement of follower 6 as shown in FIGS. 13 to 15. Also, complementary ramp 37 of follower 6 is in contact to or faces inlet incline 19, and rising 25 of follower 6 faces or is in contact to edge 24 of inlet 23, but a gap is formed between intermediate ramp 36 of follower 6 and anterior ramp 16 of cam guide 5 as shown in FIG. 13. Alternatively, drive gears 26 may be in driving connection with follower gears 27 at the time of contact of proximal flat 31 to proximal surface 20 once end surface 39 reaches proximal path 12, and a spring or elastic medium for producing elastic buffer action may be used in at least one of interlocked drive and follower gears 26 and 27.

In this way, according to the bill handling apparatus of the present invention, when validator 2 is mounted on frame 1, follower 6 may be fit into and slid on ridged surface 14 along distal path 10 of cam guide 5 toward the fixed position of validator 2 while preventing undesirable impact of drive gears 26 in validator 2 with bracket 7 and upper surface 62 of stacker 3. This also ensures that validator 2 can be safely horizontally moved over, in parallel relation to and relative to top surface 62 of stacker 3 while maintaining conveyer device 102 in a spaced relation from bracket 7 and stacker 3. After that, follower 6 can be moved at an angle along access path 11 while moved closer to stacker 3 and finally follower 6 reaches proximal path 12 while proximal flat 31 of follower 6 comes into contact to proximal surface 20 of cam guide 5. After follower 6 reaches proximal path 12, it is further moved horizontally to the proper fixed position for validator 2 by the slight backward distance, and therefore, drive gears 26 of validator 2 are directly meshed with follower gears 27. Also, when follower 6 enters proximal path 12, protective ridges 58 on bottom surface 52 of validator 2 can be fit into mating grooves 64 on top surface 62 of stacker 3, and moreover, outlet 55 of validator 2 comes in perfect register with inlet 63 of stacker 3 while validator 2 can correctly be put in the proper fixed position of frame 1.

In this embodiment, connector 4 can be made as outer formative configurations of frame 1 and validator 2 without need of any additional component or prior art connector between cam guide 5 and follower 6, and therefore, the bill handling apparatus may increase height and length in stacker 3 to expand its content for accommodating bills therein. Also, as stacker 3 may have its extended length, it can receive longer bills prior art stackers cannot stow, and obviously this widens application ranges of bill handling apparatus. Although follower gears 27 of stacker 3 are located within stacker 3 not to project beyond top surface 62 of stacker 3, validator 2 can be mounted on frame 1 in a predetermined fixed position while protecting drive gears 26 of validator 2 against undesirable collision with externals upon attachment and detachment operation of validator 2 with respect to frame 1, thereby extending service life of the bill handling apparatus.

As shown in FIG. 12, when follower 6 is moved along distal path 10, lever slant 85*a* of stopper 85 in latch device 8 is brought into contact to an edge 7*b* of bracket 7 (FIG. 7) to forcibly rotate latchet lever 81 in the clockwise direction around shaft 84 against elastic force of spring 86, and therefore stopper 85 runs on and moves sliding on upper surface of bracket 7. Then, follower 6 is moved down at a slant along back and anterior ramps 15, 16 through access path 11 during which stopper 85 remains in contact with upper surface of bracket 7. When end surface 39 of follower 6 is brought into contact to innermost surface 22 of proximal path 12, elastic force of spring 86 rotates latchet lever 81 in the counterclockwise direction to engage stopper 85 in opening 7*a* of bracket 7 so that latch device 8 serves to set validator 2 in the fixed position of frame 1 and also to certainly prevent abrupt withdrawal of validator 2 from frame 1. In this way, cam guides 5 and mating followers 6 provide a slip-on construction for promptly and easily mounting validator 2 on frame 1 without producing any mechanical collision therebetween.

When validator 2 is removed from frame 1, handle 83 is manually rotated downward against resilient force of spring 86 to rotate latchet lever 81 upward in the clockwise direction through pin 87 as handle 83 is rotated in the counterclockwise direction around axis 88. Clockwise rotation of latchet lever 81 releases engagement between stopper 85 and opening 7*a* to allow validator 2 to be pulled forward so that followers 6 can be separated from cam guides 5 to remove validator 2 from frame 1 without undesirable physical contact of conveyer device 102 in validator 2 to bracket 7 and upper surface 62 of stacker 3.

The first embodiment shown in FIGS. 1 to 15 illustrates a structure of connector 4 having cam guides 5 formed on inner surfaces of side walls 41 in frame 1 and followers 6 formed on a pair of side walls 51 in validator 2. Otherwise, as in a second embodiment shown in FIGS. 16 to 20, vice versa followers 6 may be formed on inner surfaces of side walls 41 in frame 1, and cam guides 5 may be formed on a pair of side walls 51 in validator 2. It should be understood from the foregoing description that the second embodiment would produce essentially similar operations and effects as those of the first embodiment. Same symbols as those of the first embodiment shown in FIGS. 1 to 15 are used to denote similar or identical parts in the second embodiment.

Figure 16:
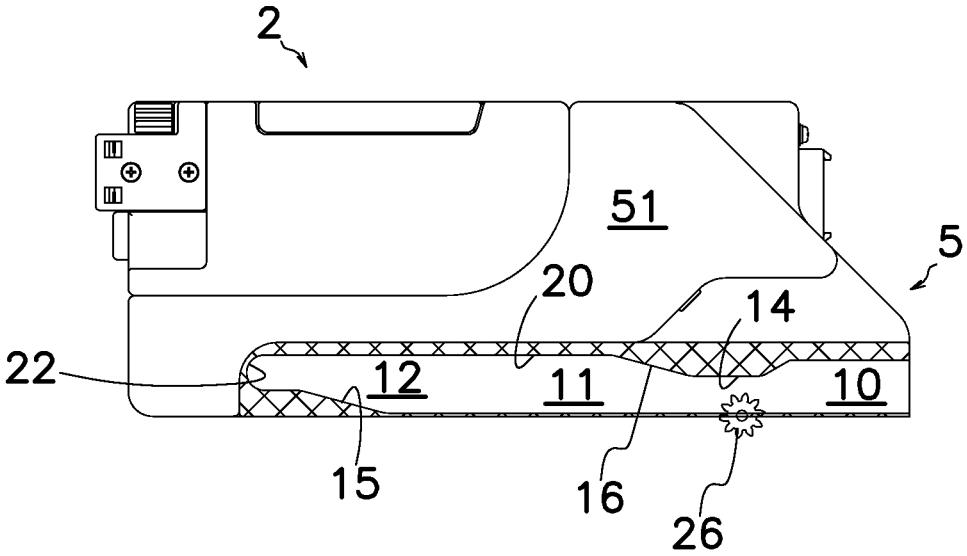
FIG. 16 is a sectional view showing a second embodiment of the present invention with a cam guide formed on a validator.
Figure 17:
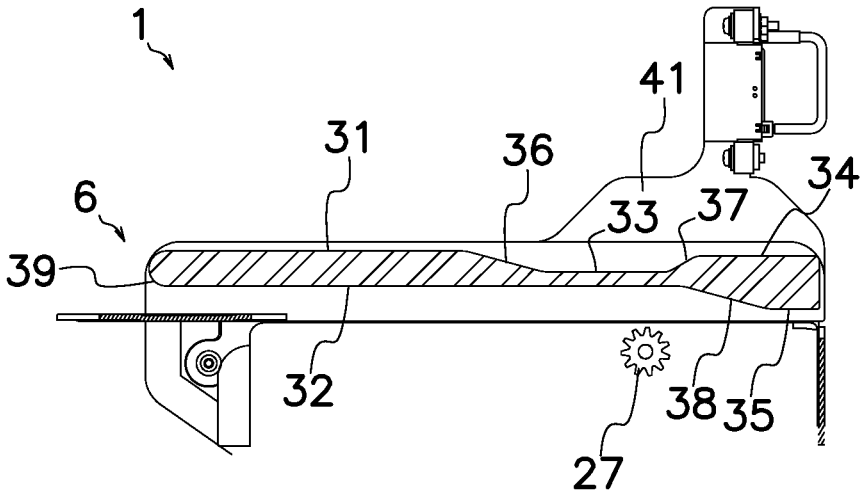
FIG. 17 is a sectional view showing the second embodiment of the present invention with a follower formed on a frame.
Figure 18:
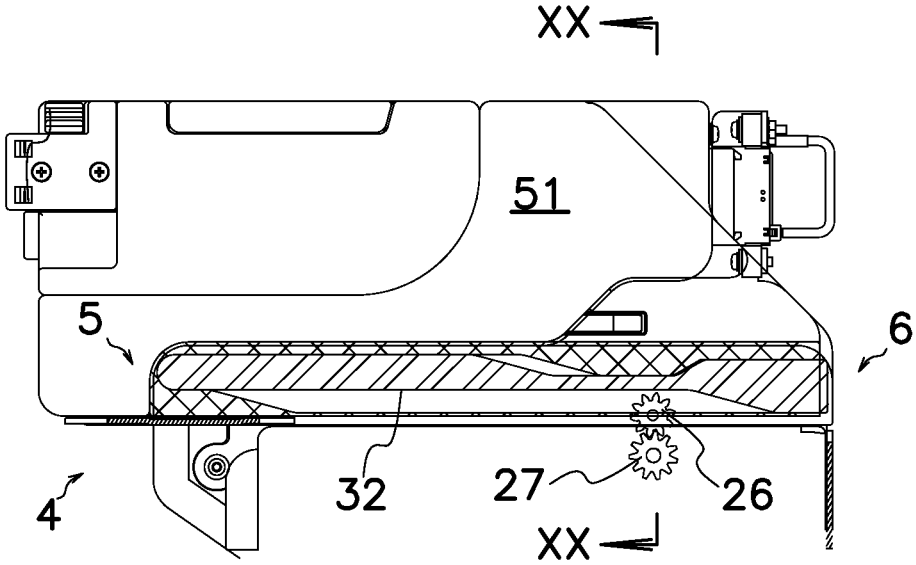
FIG. 18 is a side elevation view showing the engaged follower and cam guide in the second embodiment.
Figure 19:
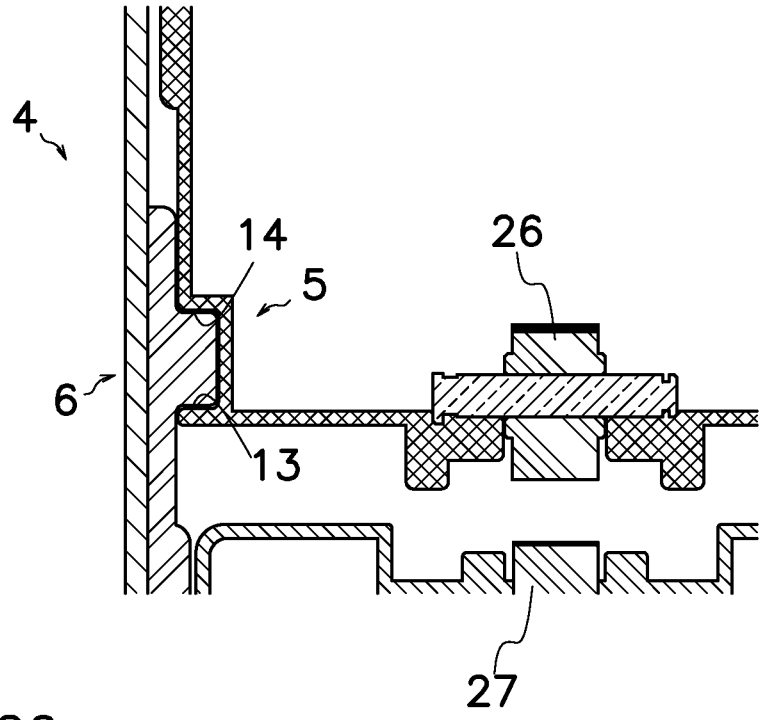
FIG. 19 is a sectional view of drive and follower gears in the spaced relation in the second embodiment.
Figure 20:
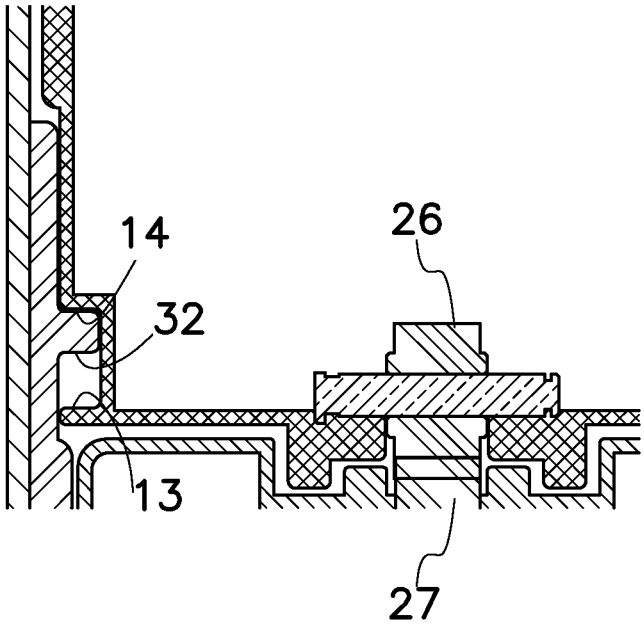
FIG. 20 is a sectional view taken along a line XX-XX of FIG. 18 showing the engaged drive and follower gears in the second embodiment.
Figure 21:
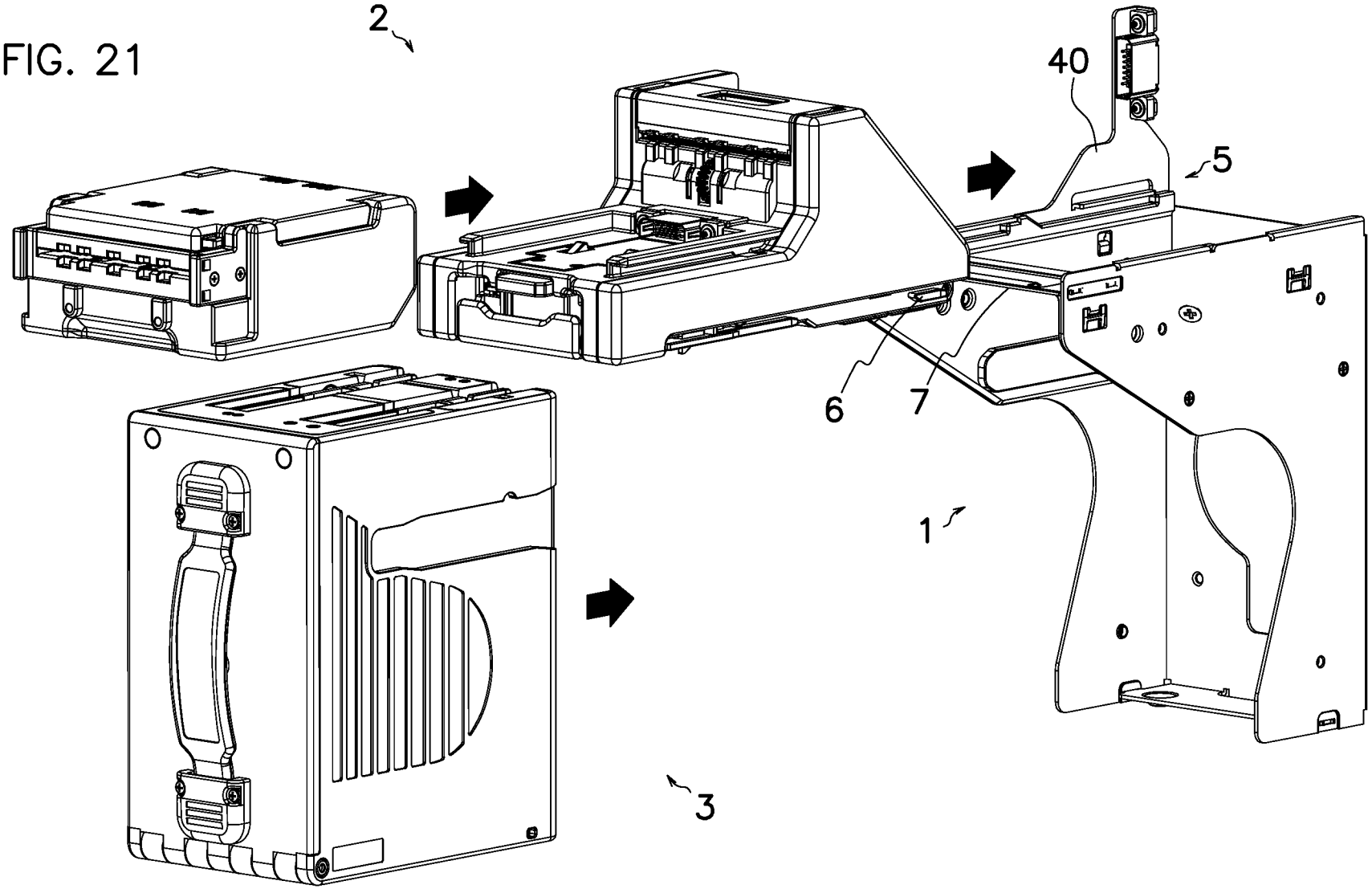
FIG. 21 is a perspective exploded view of a third embodiment of the bill handling apparatus according to the present invention.
Figure 22:
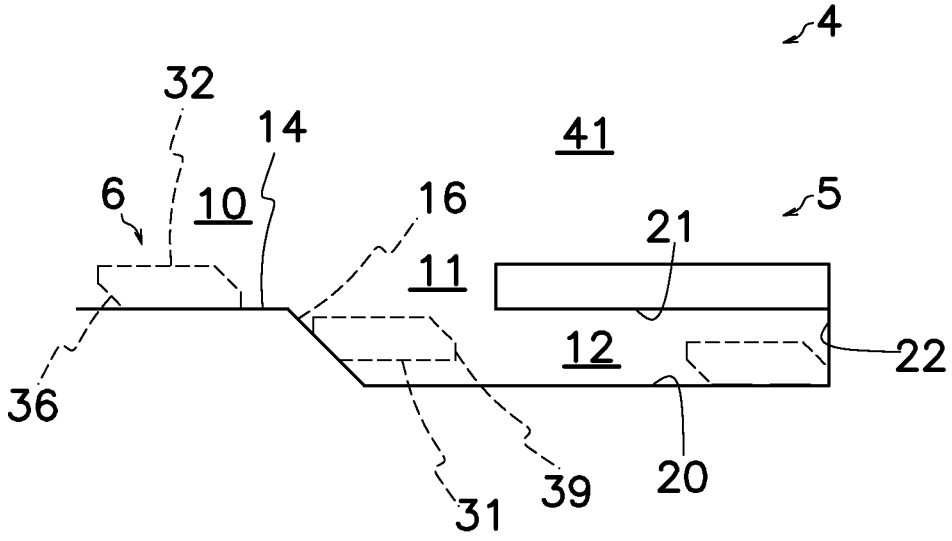
FIG. 22 is a block diagram of a cam guide and a follower according to the third embodiment of the present invention.

FIGS. 21 and 22 represent a third embodiment of the bill handling apparatus according to the present invention. Same symbols are used in FIGS. 21 and 22 to indicate substantially the same as or similar parts to those in FIGS. 1 to 20. Unlike the first and second embodiments, the third embodiment has a simplified structure as shown in FIGS. 21 and 22 by removing distal surface 13 and back ramp 15 from cam guide 5 and also by forming cross-section shape of follower 6 into a simplified shape of generally a trapezoid or parallelogram. However, it would be apparent to ordinary skill in the art that the third embodiment has the basically same construction as those in the first and second embodiments to produce equivalent functions and effects. The shown third embodiment has frame 1 formed with cam guide 5 and validator 2 formed with follower 6, however, vice versa as shown in FIGS. 16 to 18, follower 6 may be formed in frame 1, and cam guide 5 may be formed in validator 2.

The foregoing embodiments according to the present invention may be varied in various ways. For example, bracket 7 is described as connected between side walls 41 of frame 1 for improvement in rigidity of frame 1, however, discrete bracket 7 from frame 1 or integral bracket 7 with frame 1 may be secured between side walls 41 of frame 1. Frame 1 may use a roof plate of stacker 3 attached to frame 1 as a substitute for bracket 7. The present invention is also applicable to a bill handling apparatus of inverted structure with validator detachably attached to frame under stacker. The bill handling apparatus may use only a couple of a cam guide 5 and a follower 6 formed on either side wall 51 of validator 2 and mating side wall 41 of frame 1.

Embodiments according to the present invention produce the following effects:

[1] Validator 2 may be attached to and detached from frame 1 for easy replacement;

[2] Connector 4 allows to attach validator 2 to frame 1 and detach validator 2 from frame 1 without undesirable physical contact of conveyer device 102 in validator 2 to any other parts including bracket 7 and upper surface 62 of stacker 3;

[3] Validator 2 may be mounted on frame 1 in the fixed position for driving connection of conveyer device 102 to carrier device and pusher device 105 in stacker 3;

[4] Connector 4 may comprise cam guide 5 and follower 6 removably connectable each other;

[5] Cam guide 5 and follower 6 in connector 4 may be formed as outer formative configurations in frame 1 and validator 2 without need of any additional or further connection device;

[6] Connector 4 does not increase the height in the bill handling apparatus, and so stacker 3 may have its increased height or length to expand its volume for accommodating more or larger bills;

[7] Protective ridges 58 may certainly guard drive gears 26 exposed from bottom surface 52 of validator 2 against their mechanical damage by collision.

INDUSTRIAL APPLICABILITY

This invention is applicable to a bill handling apparatus having a validator detachably attached thereto to validate valuable documents, valuable paper, coupons, bank notes, security, tender, token or scrip other than bills.

What is claimed are:

1. A document handler comprising:

a frame having a pair of side walls and a bracket for connecting said side walls, a validator detachably attached to said frame, said validator comprising a bottom surface and a conveyer device having at least one drive gear that protrudes outside of said bottom surface, a stacker attached to the frame and comprising a storage, a chamber, a pusher device disposed in the chamber for stowing into the storage a document transported from the validator and a follower gear for driving the pusher device, and a connector for detachably attaching the validator to the frame, wherein the connector comprises a cam guide formed on at least one of side walls in the frame or on at least one of side walls in the validator, and a follower formed on at least one of the side walls in the validator or on at least one of the side walls in the frame to detachably bring the follower into engagement with the mating cam guide, the cam guide comprises a horizontal distal path for guiding movement of the follower to transport the validator in a spaced relation to the bracket without physical contact of the drive gear of the conveyor device to the bracket, an aslope access path connected to the distal path for guiding along the access path the follower passed through the distal path to bring the drive gear into engagement with the follower gear, and a horizontal proximal path connected to an end of the access path for guiding the follower to a fixed position.

2. The document handler of claim 1, wherein the distal path comprises a distal surface formed opposite to the bracket, and a ridged surface protruded toward the distal surface.

3. The document handler of claim 2, wherein the access path comprises a back ramp connected to the distal surface, and an anterior ramp connected to the ridged surface and disposed in parallel to the back ramp.

4. The document handler of claim 3, wherein the proximal path comprises a proximal surface continuously extending from the anterior ramp and disposed in parallel to the distal surface, a latch surface continuously extending from the back ramp and disposed in parallel to the distal surface, and an innermost surface formed between the proximal and latch surfaces.

5. The document handler of claim 1, wherein the follower comprises a proximal flat, and a distal flat formed in parallel to and in spaced relation to the proximal flat.

6. The document handler of claim 5, wherein the follower comprises an intermediate ramp connected to the proximal flat, an intermediate flat connected to the intermediate ramp and disposed in parallel to the proximal flat, and a complementary ramp connected to the intermediate flat.

7. The document handler of claim 6, wherein the follower comprises a base flat connected to the complementary ramp and disposed in parallel to the intermediate flat, a stabilizing ramp connected to the distal flat and disposed in parallel to the intermediate ramp, and an anterior flat connected to the stabilizing ramp and disposed in parallel to the distal flat.

8. The document handler of claim 1, wherein the bracket is disposed at a right angle to the side walls of the frame.

9. The document handler of claim 8, wherein a pair of the vertically disposed side walls of the frame are formed with a pair of the cam guides or a pair of the followers of the connector, a pair of the vertically disposed side walls of the validator are formed with a pair of the followers or a pair of the cam guides of the connector.

10. The document handler of claim 1, wherein the frame comprises a rear wall for connecting rear portions of the side walls, the bracket connects front portions of the side walls, the cam guide or follower is formed on the side wall in the frame, and the follower or cam guide is formed on the side wall of the validator.

11. The document handler of claim 1, further comprising a latch device disposed between the validator and bracket for preventing the validator from moving in the withdrawal direction.

12. The document handler of claim 1, wherein a pair of the cam guides are formed in the side walls in the frame, and a pair of the followers are formed in the side walls of the validator.

13. The document handler of claim 1, wherein a pair of the followers are formed on a pair of the side walls of the frame and a pair of the cam guides are formed in a pair of the side walls of the validator.

14. The document handler of claim 1, wherein the stacker comprises an inlet through which the document passes into the stacker and a carrier device for transporting a validated document into the stacker, the chamber temporarily keeps the documents passed through the inlet at a standby position therein.

15. The document handler of claim 14, wherein the drive gear of the validator is brought into engagement with the follower gear to operate the carrier device and pusher device through forward and adverse rotation of the drive and follower gears when the follower is completely inserted into the cam guide to move the validator into the fixed position in the frame.

16. The document handler of claim 15, wherein the validator comprises a plurality of protective ridges, the stacker comprises a plurality of grooves formed on a top surface, the drive gear of the validator is disposed between the protective ridges, the follower gear of the pusher device is disposed in the grooves, when the validator is moved into the fixed position of the frame, the drive gear of the validator is brought into engagement with the follower gear in the stacker, and simultaneously, the protective ridges are interlocked with the grooves in the stacker.

* * * * *